US005975841A

United States Patent [19]

Lindemuth et al.

[11] Patent Number: 5,975,841

[45] Date of Patent: Nov. 2, 1999

[54] HEAT PIPE COOLING FOR TURBINE STATORS

[75] Inventors: James E. Lindemuth, Reading; William G. Anderson, Lancaster, both of Pa.

[73] Assignee: Thermal Corp., Georgetown, Del.

[21] Appl. No.: 08/943,626

[22] Filed: Oct. 3, 1997

[51] Int. Cl.[6] ..... F01D 25/08

[52] U.S. Cl. ..... 415/114; 415/115; 415/116; 415/178; 416/96 R

[58] Field of Search ..... 415/114, 115, 415/116, 117, 175, 176, 177, 178; 416/95, 96 R; 165/104.26, 41 S

[56] References Cited

U.S. PATENT DOCUMENTS

| | | | |
|---|---|---|---|
| 2,744,723 | 5/1956 | Roush | 416/96 |
| 3,287,906 | 11/1966 | McCormick | 416/95 |
| 3,334,685 | 8/1967 | Burggraf et al. | 165/104.26 |
| 3,627,444 | 12/1971 | Lentz | 415/114 |
| 3,986,138 | 10/1976 | Neal | 165/104.26 |
| 4,019,571 | 4/1977 | Kosson et al. | 165/104.26 |
| 4,108,239 | 8/1978 | Fries | 165/104.26 |
| 4,118,756 | 10/1978 | Nelson et al. | 361/385 |
| 4,207,027 | 6/1980 | Barry et al. | 416/96 R |
| 4,218,179 | 8/1980 | Barry et al. | 415/114 |
| 4,401,151 | 8/1983 | Pozsicsanyi | 165/104.26 |
| 4,565,243 | 1/1986 | Ernst et al. | 165/104.26 |
| 4,602,679 | 7/1986 | Edelstein et al. | 165/104.26 |
| 4,770,238 | 9/1988 | Owen | 165/104.26 |
| 5,076,352 | 12/1991 | Rosenfeld et al. | 165/104.26 |
| 5,439,351 | 8/1995 | Artt | 416/96 |

*Primary Examiner*—Edward K. Look
*Assistant Examiner*—Ninh H. Nguyen
*Attorney, Agent, or Firm*—Martin Fruitman

[57] ABSTRACT

The apparatus is a heat pipe with an internal, multiple chamber evaporator for cooling a turbine engine stator vane. The evaporator comprises leading edge, middle, and trailing edge chambers within the stator vane, with the chambers defined by structural support ribs. Each chamber is constructed with a continuous fine pore metal powder wick coating the internal surfaces of the chamber and enclosing the chamber's central vapor space, except the wick at the very trailing edge of the vane is formed by screen embedded in the adjacent powder wick. The evaporator chambers have capillary arteries which extend through the adiabatic section of the heat pipe and terminate in a condenser wick within a heat sink structure exposed to cooler air. A capillary artery also interconnects the wick of the trailing edge chamber to the wick of the middle chamber.

10 Claims, 3 Drawing Sheets

HEAT PIPE COOLING FOR TURBINE STATORS

The United States Government has certain rights to this invention pursuant to Contract No. C-DAAJ02-94-C-0023 between the U.S. Army and Thermacore, Inc.

BACKGROUND OF THE INVENTION

This invention deals generally with turbine engines and more specifically with the cooling of turbine engine stators.

It is generally acknowledged that the performance of turbine engines is limited by the requirements for cooling the engine components. Although increasing engine operating temperatures would improve engine performance, such temperature increases will adversely affect the materials used for engine components unless engine cooling is significantly improved.

One of the critical components requiring cooling is the turbine nozzle. In the present designs for high pressure turbine engines, cooling of the nozzle is typically accomplished by bleeding air from the compressor and directing the air through the nozzle components to be cooled. However, such a technique adversely affects the performance of the engine. The bleeding of compressor air increases fuel consumption, decreases shaft horsepower, reduces the efficiency, and decreases the power to weight ratio.

There have been some attempts to build heat pipes into turbine components, but these efforts have not been directed toward achieving the necessary cooling effects. U.S. Pat. Nos. 4,207,027 to Barry et al and 5,439,351 to Artt have disclosed turbine airfoils with internal heat pipes, however, the goals of those patents were merely to equalize the temperature throughout the air foil, and neither patent addressed disposing of the heat to which the components were subjected.

In order to improve the performance of a high temperature turbine it is imperative, not only to equalize the temperature on the components, but also to transfer the heat to locations from which it can be removed so that the components can be maintained at lower temperatures.

SUMMARY OF THE INVENTION

The present invention uses heat pipes within the stator of a turbine engine nozzle to transfer the heat from the stator to a remote location for disposal.

The invention is a heat pipe for cooling a turbine engine stator airfoil blade which has a multiple chamber heat pipe evaporator within the blade. The structure has an evaporator section located within each of three chambers. These evaporators, formed as leading edge, middle, and trailing edge chambers within the blade are separated by structural support ribs within the airfoil structure. The leading edge and middle section evaporator chambers inside the blade shaped airfoil are each constructed with a continuous fine pore metal powder wick covering the entire internal surface of the chamber. Each wick thereby surrounds its chamber's central vapor space.

However, the wick in the trailing edge of the blade can be formed somewhat differently. While three sides of the inside surface of the chamber are coated with metal powder wick, the narrowed portion at the very trailing edge can be filled with screen wick which is in capillary contact with the adjacent metal powder wick, but extends into the vapor space of the trailing edge chamber. This configuration provides a large pore path along which vapor generated at the very trailing edge of the chamber can more easily be vented to the chamber's vapor space.

In order to help assure that the temperatures within the three chambered evaporator are equalized, the wicks of the various chambers can be interconnected with each other. One method is to connect the wick of one chamber to the wick of another chamber by a capillary artery. It is also practical to join the wicks of two chambers with a connection wick by extending metal powder wick between two chambers by forming wick around or through openings in the support ribs within the turbine stator. Thus, liquid is easily transferred between two chambers because the same capillary artery is embedded in the metal powder wick in each of the chambers or the metal powder wicks of the chambers are actually continuous. Such capillary connections are relatively short because they only pass through or around the support ribs between the chambers.

The leading edge chamber and middle chamber of the evaporator also each have capillary arteries which extend through the adiabatic section of the heat pipe and terminate in the heat pipe condenser wick in the heat sink structure which is located within and cooled by the stream of the input air to the combustor. For ease of construction, it is desirable to simply continue one of the capillary arteries which interconnect the condenser to the middle chamber into the trailing edge chamber so that it serves as the capillary connection between the wicks in the middle and trailing edge chambers.

The invention can therefore cool the turbine stator blades which are subjected to the extreme temperatures of the combustor output air, transferring the heat from the stators to the cooler combustor input air. Parenthetically, the heating of the combustor input air by the heat pipe condenser favorably affects the engine efficiency.

DETAILED DESCRIPTION OF THE INVENTION

Figure 1:
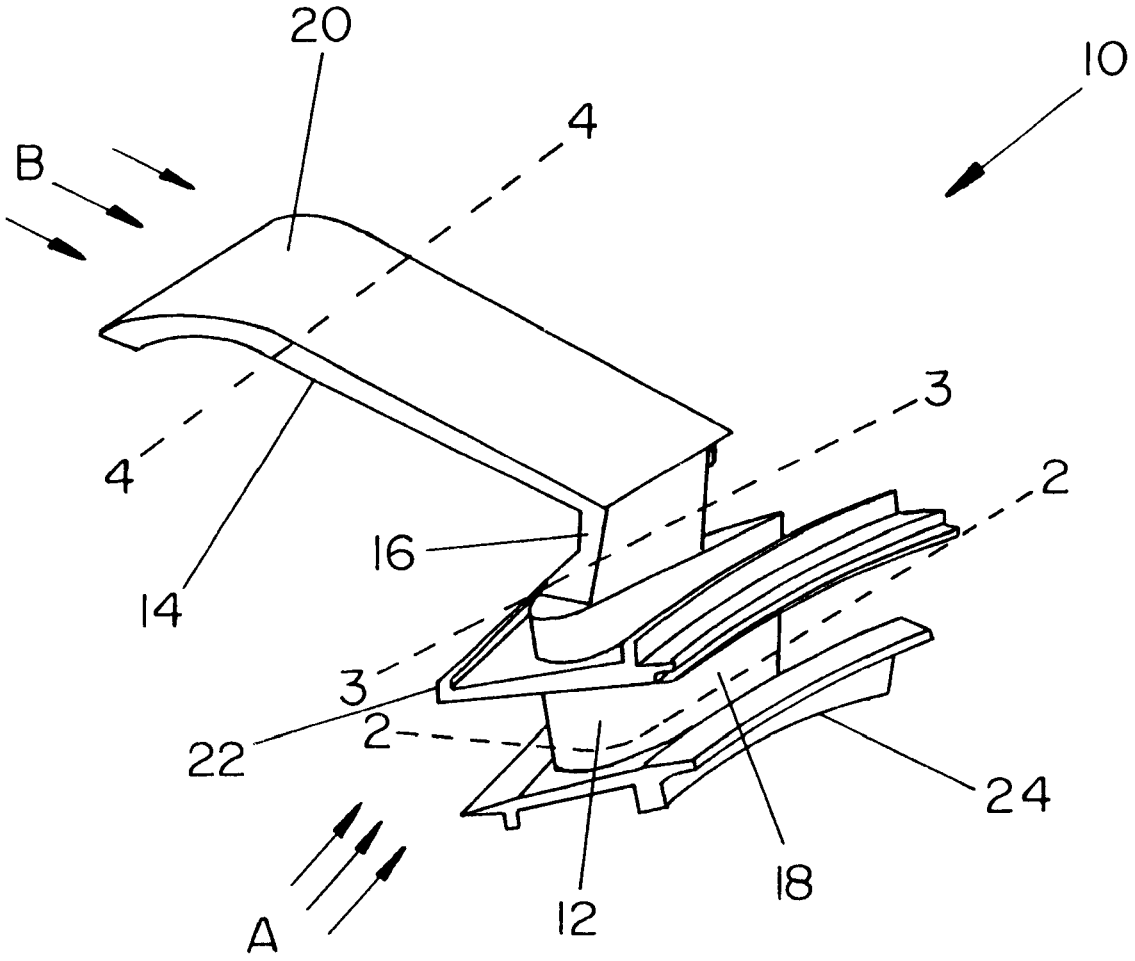
FIG. 1 is a perspective view of a portion of the structure of a high pressure turbine nozzle.

FIG. 1 is a perspective view of a portion of the typical structure of a high pressure turbine nozzle which includes the invention, a nozzle cooling heat pipe 10 within which evaporator section 12 is connected to condenser section 14 through adiabatic section 16. In normal operation of the turbine, engine stator vane 18 is located within stream A of the engine combustor hot outlet gas, and is therefore heated to extremely high temperatures. However, combustor inlet air B, which is much cooler than output gases A, is also available, and the present invention uses it to advantage.

Heat pipe 10 transfers heat from stator vane 18 to condenser fin 20, and thereby not only cools stator vane 18 but advantageously preheats input air B. It should be appreciated that stator vane 18 and condenser fin 20 are each just one of many such structures in the typical gas turbine nozzle. There are many more stator vanes attached to shroud band 22 and hub band 24, and they are all located to form a cylindrical pattern of adjacent vanes through which the output gases are discharged to drive the turbine.

Figure 2:
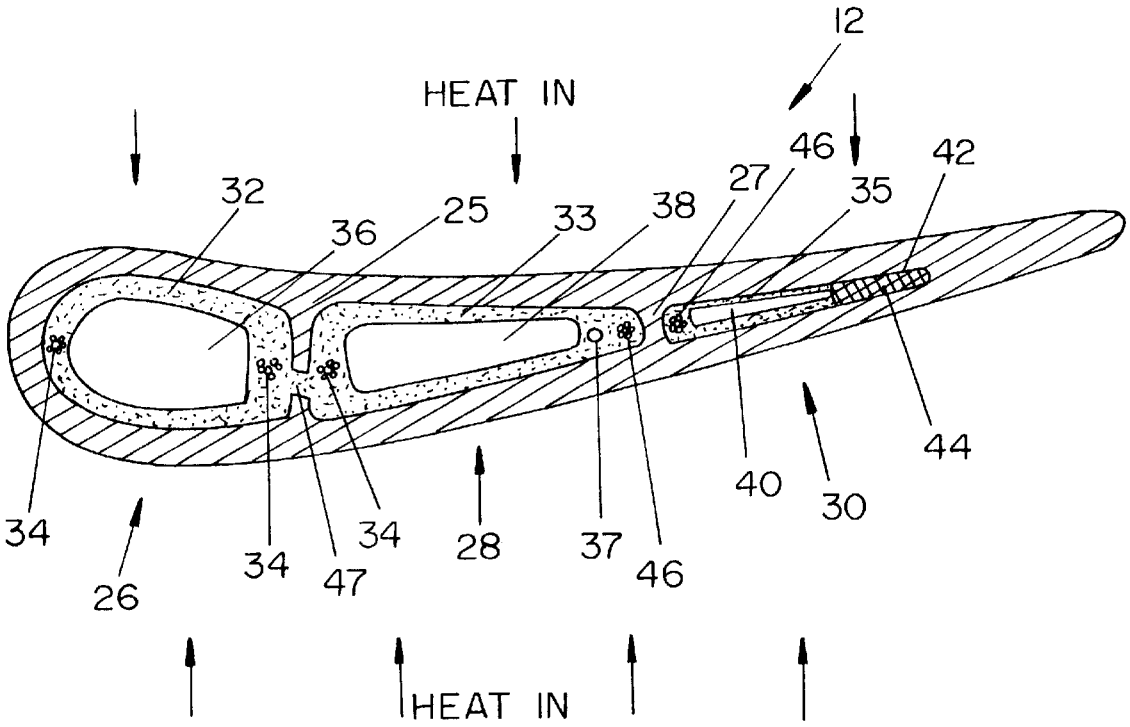
FIG. 2 is a cross section view of the heat pipe evaporator section of the turbine nozzle of FIG. 1 at location 2—2.

FIG. 2 is a cross section view of evaporator section 12 of heat pipe 10 of the turbine nozzle of FIG. 1 at location 2—2. Evaporator section 12 is constructed as three chambers, leading edge chamber 26, middle chamber 28, and tapered trailing edge chamber 30 separated by structural ribs 25 and 27. Leading edge chamber 26 and middle chamber 28 are constructed similarly in that they have powdered metal wicks 32 and 33 covering their entire internal surfaces and thus enclosing their respective vapor spaces 36 and 38. Capillary arteries 34 and 37 are embedded in metal powder wicks 32 and 33 to serve as liquid flow paths from heat pipe condenser 14 in order to supply evaporator section 12 with liquid for evaporation. Capillary arteries can be either cable arteries 34, which are essentially a cable constructed of multiple continuous strands with capillary spaces between the strands, or as shown at capillary artery 37, a simple tube of appropriate capillary cross section.

In the preferred embodiment shown in FIG. 2, trailing edge chamber 30 is similar to leading edge chamber 26 and middle chamber 28 in that most of three of its internal surfaces are covered with metal powder wick 35. However, narrow cross section 42 of trailing edge chamber 30, the portion nearest to the trailing edge of evaporator section 12 of heat pipe 10, does not include metal powder. Instead, in order to provide a large pore path along which vapor generated at the very trailing edge of the chamber can be vented to the chamber's vapor space 40, screen wick 44 can be installed to fill narrow cross section 42. Screen wick 44 is in close capillary contact with metal powder wick 32 where they meet, but at least a part of screen wick 44 is open directly onto vapor space 40. Thus vapor generated within narrow cross section 42 has relatively unimpeded access to vapor space 40.

Another feature of trailing edge chamber 30 is that cable artery 46, which is embedded into metal powder wick 35 of trailing edge chamber 30 extends into middle chamber 28 and into metal powder wick 33 within middle chamber 28. This capillary connection formed by cable artery 46 helps assure that metal powder wick 35 and screen wick 44 will not be dried out by heat concentrated at the trailing edge of heat pipe evaporator section 12. It is particularly beneficial to have cable artery 46 extend not only into middle chamber 28, but to also use cable 46 as the capillary artery connection between middle chamber 28 and condenser 14. With such a structure not only does cable artery 46 furnish liquid to wicks 33 and 35, but because cable artery 46 interconnects the two wicks by following a short path through support rib 27, wick 33 also acts as a reserve liquid supply for wick 35.

To achieve similar liquid movement among all the evaporator chambers, it is sometimes advantageous to use metal powder wicks such as connection wick 47 to interconnect metal powder wicks 32 and 33. Metal powder wick connection 47 is formed around or within holes in support rib 25.

Figure 3:
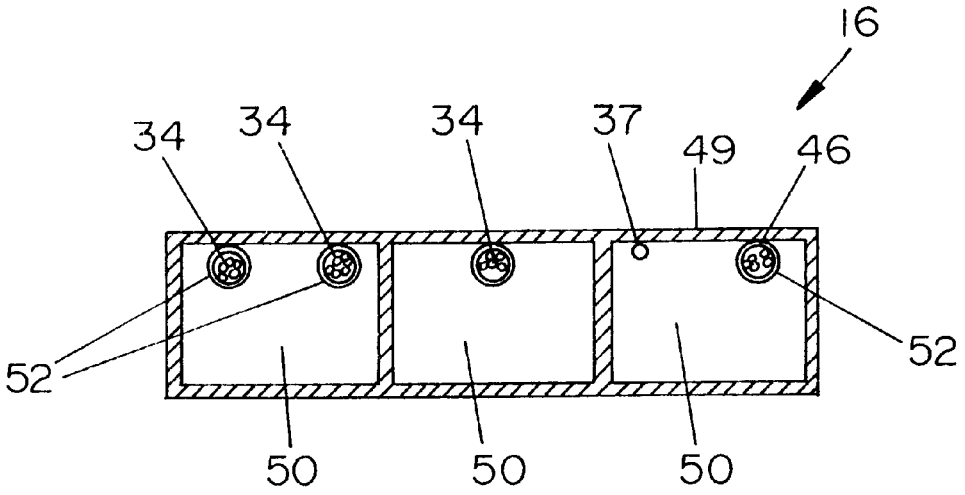
FIG. 3 is a cross section view of the heat pipe adiabatic section of the turbine nozzle of FIG. 1 at location 3—3.

FIG. 3 is a cross section view of adiabatic section 16 of heat pipe 10 of the turbine nozzle of FIG. 1 at location 3—3. Adiabatic section 16 is actually simply an enclosed structure 49 with one or more vapor paths 50, which can be divided into any convenient configuration, and capillary arteries 34, 37, and 46, which are continuous from evaporator section 12 to condenser section 14. However, within adiabatic section 16, cable arteries 34 and 46 are fully encased within metal sheath 52 to separate the liquid within the cable arteries from the opposing flow of vapor.

Figure 4:
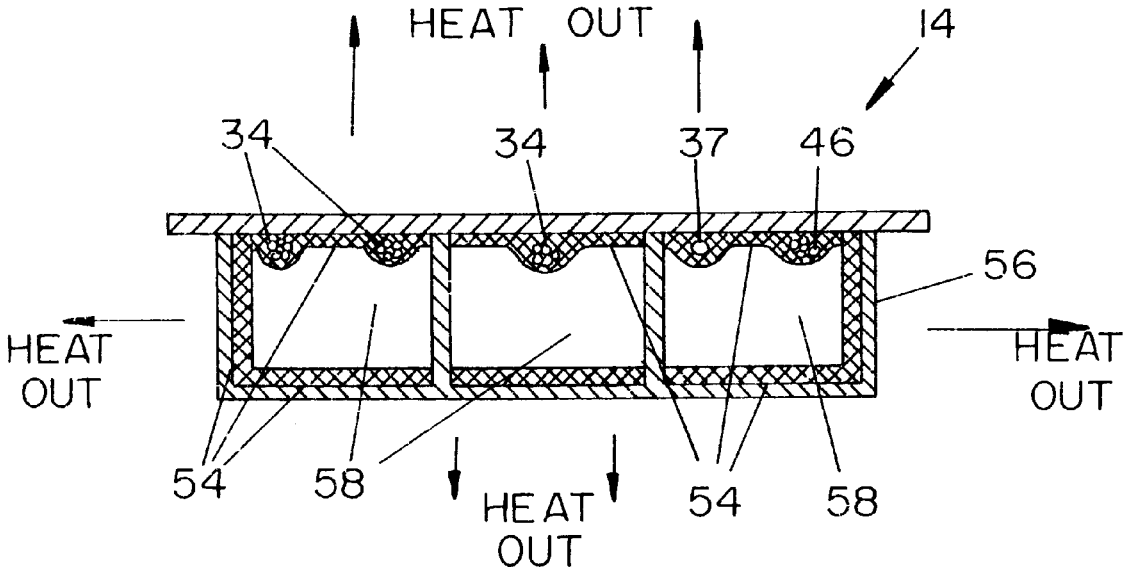
FIG. 4 is a cross section view of the heat pipe condenser section of the turbine nozzle of FIG. 1 at location 4—4.

FIG. 4 is a cross section view of condenser section 14 of heat pipe 10 of the turbine nozzle of FIG. 1 at location 4—4. Condenser section 14 is a conventional heat pipe condenser with condensing metal screen wick 54 covering the internal surfaces of enclosed structure 56. Capillary arteries 34, 37, and 46, which extend all the way from evaporator 12, are also covered with continuous wick 54 within condenser section 14. As is common when tube capillary arteries are used, the portions of tube artery 37 which are embedded within evaporator wick 33 and condenser wick 54 can either be perforated or have splits within them to create easier liquid access between the wick and the interior of the capillary tube.

Thus, conventional heat pipe operation occurs when vapor which has moved from evaporator section 12 through adiabatic section vapor spaces 50 into condenser vapor spaces 58 condenses on wick 54, which is being cooled by input air B (FIG. 1). The condensed liquid then moves by capillary action through condenser wick 54, into capillary arteries 34, 37, and 46 and along the capillary arteries through adiabatic section 16 to evaporator section 12. In evaporator section 12 capillary forces continue to pump the liquid from the capillary arteries into evaporating wicks 32, 33, 35, and 44, within which the heat of the combustor output gases A (FIG. 1) cause the liquid to evaporate into vapor. The vapor then moves back to the condenser and the process is continuous.

The material of the preferred embodiment of the invention is essentially 316 stainless steel. This material is used in powder form for evaporator wicks 32, 33, and 35 and as screen for evaporator wick 44 and condenser wick 54, which is three wraps of 325 to 635 mesh stainless steel screen. Cable arteries 34 and 46 are also stainless steel and tube artery 37 and sheath 52 are stainless steel tubing. For the preferred embodiment 316 stainless steel is also used for the envelope for the condenser and the adiabatic sections while the evaporator envelope is constructed from Haynes 188 cobalt based super alloy.

By the use of the present invention and the materials of the preferred embodiment it is possible to operate a high pressure turbine stator at temperatures up to 1650 degrees centigrade and at pressures up to 250 pounds per square inch. Furthermore, the invention is expected to reduce fuel consumption by 1.6%, increase shaft horsepower by 1.8%, increase turbine efficiency by 1.8%, and increase the power-to-weight ratio by approximately 1.0%. Despite the seeming small numbers these improvements are considered significant results for high pressure turbines.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For example, materials other than stainless steel can be used for the various components to attain higher temperatures, more or fewer evaporator chambers and capillary arteries could be used, and, in some circumstances, screen wick 44 can be omitted and replaced with additional metal powder wick. Furthermore, cooling air can be supplied from sources other than turbine input air.

What is claimed as new and for which Letters patent of the United States are desired to be secured is:

1. A heat pipe for cooling a turbine engine stator comprising:

an evaporator section enclosed within a turbine stator vane which is exposed to hot gases, the evaporator section having a tapered trailing edge and comprising at least one chamber, with at least one chamber including an evaporator capillary wick attached to its internal surfaces and an evaporator vapor space adjacent to the evaporator capillary wick, and a portion of the evaporator capillary wick extending into the tapered trailing edge of the vane;

a condenser section comprising a condenser enclosure separate from the stator vane and in communication with the vane, with external portions of the condenser enclosure exposed to air cooler than the gases to which the vane is exposed, the condenser section including a condenser capillary wick attached to the internal surfaces of the condenser enclosure portions exposed to the cooler air and a condenser vapor space within the condenser enclosure and adjacent to the condenser capillary wick, with the condenser vapor space in communication with the evaporator vapor space; and at least one capillary artery extending between the evaporator section and the condenser section and embedded within the evaporator capillary wick and the condenser capillary wick, for moving liquid from the condenser capillary wick to the evaporator capillary wick.

2. The heat pipe of claim 1 wherein the evaporator capillary wick is powdered metal wick.

3. The heat pipe of claim 1 wherein the portion of the evaporator capillary wick extending into the tapered trailing edge of the vane is a screen wick in contact with the remaining evaporator capillary wick and exposed to the evaporator vapor space.

4. The heat pipe of claim 1 wherein the evaporator section includes at least a leading edge chamber and a trailing edge chamber separated and defined by at least one structural rib and each chamber contains a part of the evaporator wick.

5. The heat pipe of claim 4 further including a capillary artery connecting parts of the evaporator wick.

6. The heat pipe of claim 4 further including a capillary connection wick connecting parts of the evaporator wick.

7. The heat pipe of claim 1 wherein an adiabatic section is attached between the condenser enclosure and the vane and serves as a communication means between the condenser vapor space and the evaporator vapor space, and at least one capillary artery passes through the adiabatic section.

8. The heat pipe of claim 1 wherein at least one capillary artery comprises a tube artery.

9. The heat pipe of claim 1 wherein at least one capillary artery comprises a cable artery.

10. The heat pipe of claim 1 wherein a capillary artery comprises a cable artery and a portion of the cable artery outside the evaporator section and the condenser section is enclosed within a sheath.

* * * * *